US007596814B1

(12) United States Patent
Corby et al.

(10) Patent No.: US 7,596,814 B1
(45) Date of Patent: Oct. 6, 2009

(54) PATIENT GARMENT AND DRESSING USE THEREOF

(76) Inventors: Pamela Smith Corby, 63 Laurel Hill, Centerport, NY (US) 11721; Julia Papa, 80 Woodcut La., Manhasset, NY (US) 11030

( * ) Notice: Subject to any disclaimer, the term of this patent is extended or adjusted under 35 U.S.C. 154(b) by 0 days.

(21) Appl. No.: 11/487,758

(22) Filed: Jul. 17, 2006

(51) Int. Cl.
*A41D 10/00* (2006.01)

(52) U.S. Cl. ..... 2/114; 2/83

(58) Field of Classification Search ..... 2/114, 2/83, 75, 111, 69, 115, 227, 228
See application file for complete search history.

(56) References Cited

U.S. PATENT DOCUMENTS

| | | | | | |
|---|---|---|---|---|---|
| 459,106 | A | * | 9/1891 | Fifield | 2/114 |
| 818,351 | A | * | 4/1906 | Clark | 2/114 |
| 1,489,046 | A | * | 4/1924 | Thompson | 2/114 |
| 2,520,026 | A | * | 8/1950 | Beitchman | 2/227 |
| 2,736,900 | A | * | 3/1956 | Koren | 2/114 |
| 3,721,998 | A | * | 3/1973 | Meyers | 2/74 |
| 4,055,855 | A | * | 11/1977 | Ragone et al. | 2/105 |
| 4,068,315 | A | * | 1/1978 | Rainville | 2/114 |
| 4,258,440 | A | * | 3/1981 | McGowan | 2/114 |
| 4,382,303 | A | * | 5/1983 | Lunt | 2/114 |
| 4,422,186 | A | * | 12/1983 | Loney | 2/114 |
| 4,570,268 | A | * | 2/1986 | Freeman | 2/114 |
| 4,651,353 | A | * | 3/1987 | Walden | 2/227 |
| 4,718,124 | A | * | 1/1988 | Sawicki et al. | 2/114 |
| D305,575 | S | * | 1/1990 | Gordon et al. | D2/720 |
| 4,995,115 | A | * | 2/1991 | Ellis | 2/69 |
| 5,097,535 | A | | 3/1992 | Dye et al. | |
| 5,191,659 | A | * | 3/1993 | Backus | 2/227 |
| 5,315,716 | A | * | 5/1994 | Baum | 2/227 |
| 5,553,323 | A | * | 9/1996 | Chou et al. | 2/114 |
| 5,603,123 | A | * | 2/1997 | Chupa | 2/275 |
| 5,611,087 | A | * | 3/1997 | Adkins | 2/114 |
| 5,727,255 | A | * | 3/1998 | Minks | 2/69 |
| 5,887,279 | A | | 3/1999 | Elting et al. | |
| 5,991,923 | A | * | 11/1999 | Maria | 2/83 |
| 6,012,166 | A | * | 1/2000 | Burbidge | 2/83 |
| 6,105,171 | A | * | 8/2000 | Niedermeyer | 2/114 |
| 6,240,563 | B1 | * | 6/2001 | Niedermeyer | 2/114 |
| 6,548,728 | B1 | * | 4/2003 | Faries et al. | 602/42 |
| 6,694,521 | B1 | * | 2/2004 | Hopkins | 2/83 |
| 2002/0152535 | A1 | * | 10/2002 | Gaza | 2/114 |
| 2003/0126668 | A1 | * | 7/2003 | Scroggins | 2/114 |
| 2004/0010837 | A1 | * | 1/2004 | Graves | 2/114 |
| 2006/0156450 | A1 | * | 7/2006 | McGrath | 2/114 |

* cited by examiner

*Primary Examiner*—Alissa L Hoey
(74) *Attorney, Agent, or Firm*—Myron Amer P.C.

(57) ABSTRACT

A hospital patient garment constituted of upper and lower garment panels that the patient assumes a position interposed between front and rear portions of the panels by wearing same and, thusly worn, concomitantly achieves alignment of edges for attachment to each other contributing to unassisted or minimal assistance in practicing a dressing-up use of the garment.

1 Claim, 3 Drawing Sheets

PATIENT GARMENT AND DRESSING USE THEREOF

The present invention relates generally to improvements in a garment for a patient during a hospital stay, the improvements more particularly enabling the patient to dress her/him self in the garment without the assistance of a nurse, family member or the like, all as will be better understood as the description proceeds.

BACKGROUND OF THE INVENTION

As known from common experience the civilian attire of an individual checking into a hospital or like facility is replaced by a hospital-issued garment which in use does little more than serve as a bodily covering, and, in practice, especially for a female patient, does not serve her modesty requirements, is difficult to put on without assistance, and has other drawbacks.

Prior patents, as exemplified by U.S. Pat. No. 5,097,535 for "Garment For Use In Health Care Situations" issued to Dye et al. on Mar. 24, 1992 and by U.S. Pat. No. 5,887,279 for "Surgical Garment For A Patient" issued to Elting et al. on Mar. 30, 1999, to mention an exemplary few, address the shortcomings of hospital-issued garments, but fail to overcome their shortcomings, except for embodying a more stylish appearance and providing a more effective bodily covering satisfying the modesty of the wearer. What is lacking in the '535, '279 patents and all other known patented patient garments, is a construction which contributes to the dressing-up use of the garment by the patient without the assistance of another.

BRIEF SUMMARY OF THE INVENTION

Broadly, it is an object of the present invention to overcome the foregoing and other shortcomings of the prior art, and particularly the providing of an unassisted dressing-up mode of use of the patient garment.

More particularly, it is an object to provide upper torso and lower torso cooperating garments in which the edges thereof delimiting their arm and leg coverings are in alignment as a consequence of being worn on the person, thereby obviating an assisted alignment as heretofore required because an upper torso and lower torso garment component was each provided in two parts and assistance was required in urging same in closing movement upon the patient. The aligned edges are releasably attached to each other to complete the construction of garment sleeves and trousers, and unattached to provide access to the patient's arms and legs for medical procedures.

BRIEF DESCRIPTION OF THE SEVERAL VIEWS OF THE DRAWING

The description of the invention which follows, together with the accompanying drawings should not be construed as limiting the invention to the example shown and described, because those skilled in the art to which this invention appertains will be able to devise other forms thereof within the ambit of the appended claims.

DETAILED DESCRIPTION OF THE INVENTION

Figure 1:
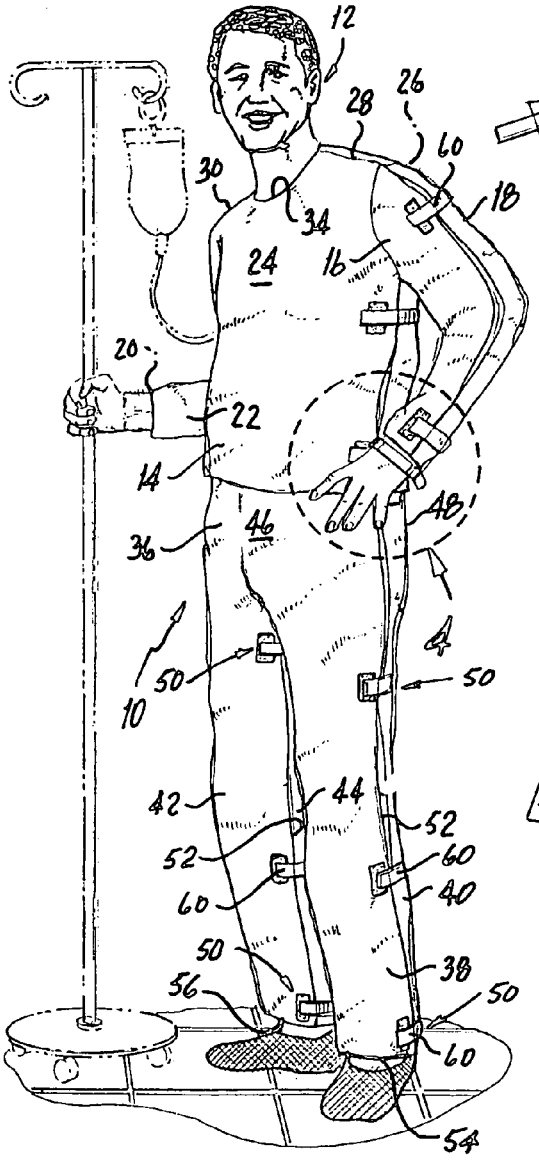
FIG. 1 is a perspective view of a patient with minimal assistance using the dressing method of the present invention shown wearing the garment, also of a construction according to the present invention.
Figure 2:
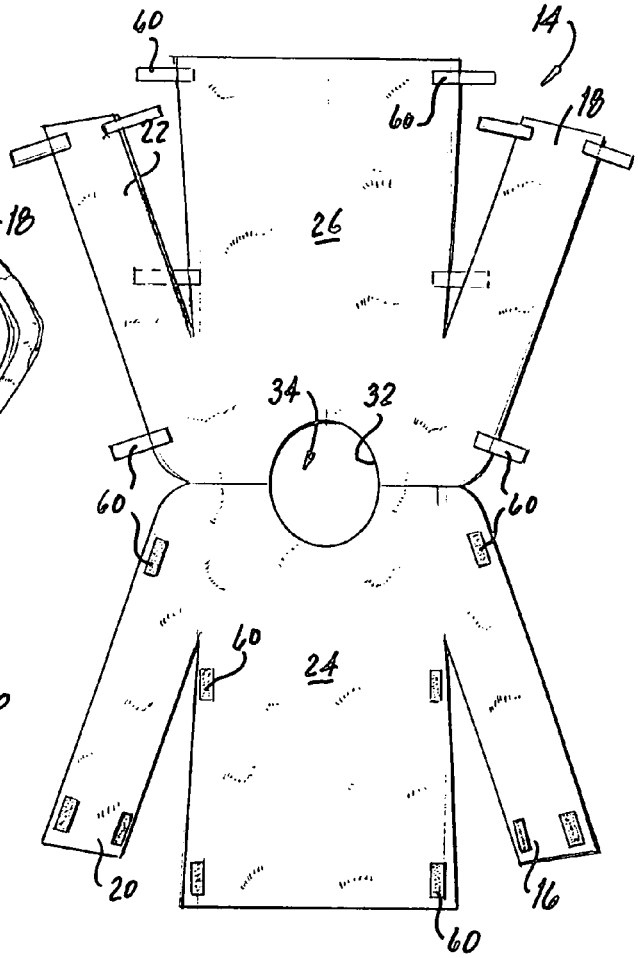
FIG. 2 is a plan view, in the flat, of the upper torso garment component.
Figure 4:
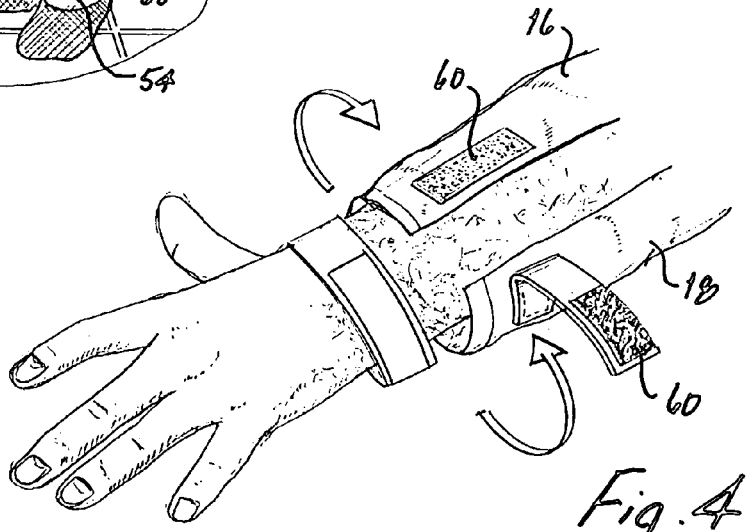
FIG. 4 is a partial perspective view illustrating details of the within inventive dressing method.
Figure 3:
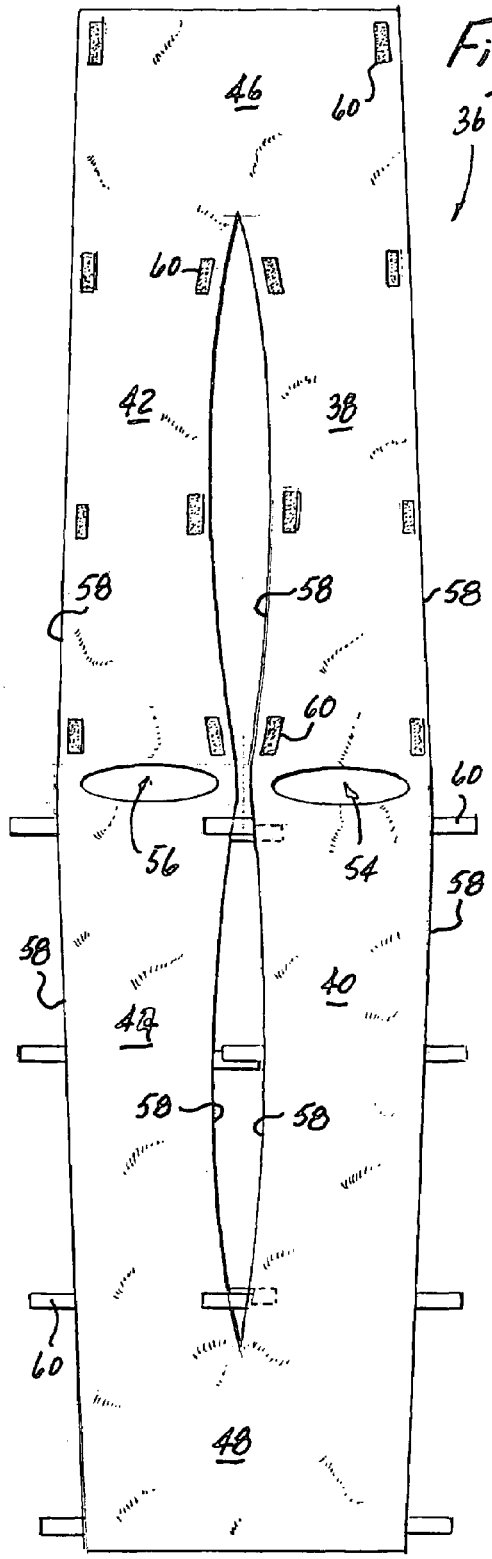
FIG. 3 is a like plan view, in the flat, but of the lower torso garment component.

Shown in the drawings is a garment, generally designated 10, of fabric material that is intended primarily for a hospital patient 12, characterized in that the manner in which it is constructed enables the patient 12 to dress her/him self without assistance, or with minimal assistance. Also, and particularly for a female patient, the garment 10 is a bodily covering serving modesty requirements, while for an attending doctor or caregiver, the covering is not at the expense of preventing access to the patient's arms, legs and the like for medical procedures, all as will be better understood as the description proceeds.

In a preferred embodiment, the garment 10 is die cut in the flat into an upper torso panel 14 having cooperating left arm extensions 16 and 18 and right arm extensions 20 and 22, cooperating upper torso front panel 24 and upper torso back panel 26, a left shoulder covering 28 and right shoulder covering 30 each interconnected between the panels 24 and 26, and edges 32 bounding a neck opening 34.

To the same end, the garment 10 is also die cut in the flat into a lower torso panel 36 having cooperating left leg coverings 38 and 40, right leg coverings 42 and 44, cooperating front or stomach covering 46 and rear or buttock covering 48, each of said leg coverings 38, 40, 42 and 44 interconnected at locations individually and collectively designated 50, and edges 52 bounding a left dressing opening 54 and a right dressing opening 56.

The plural edges delimiting the aforesaid noted panels and extensions are individually and collectively designated 58 and are the sites of sewn attachment therealong of cooperating strips of hook and loop fasteners, individually and collectively designated 60, the utility of which strips 60 will soon be apparent.

Figure 5:
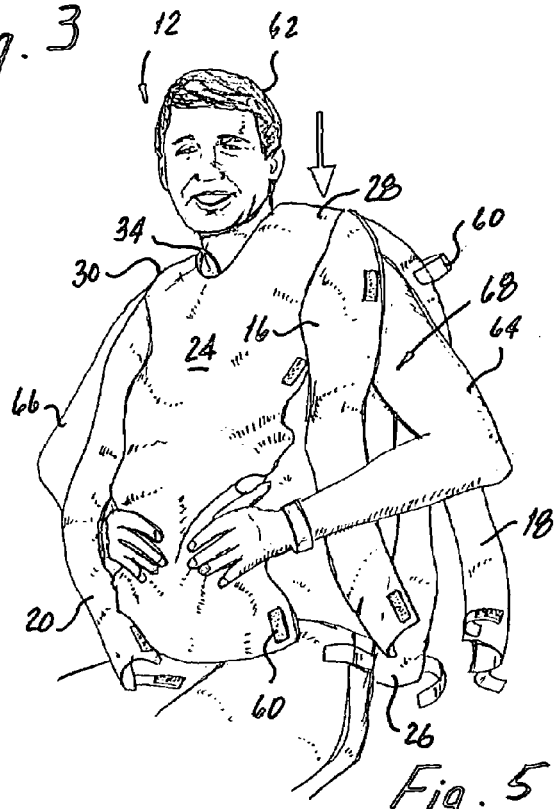
FIG. 5 illustrates the unassisted upper torso-adorning method step using the upper torso garment component of FIG. 2.
Figure 6:
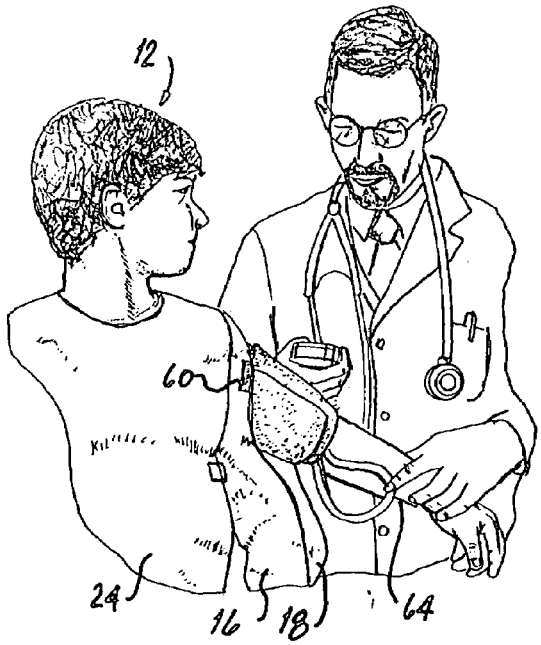
FIG. 6 is a partial perspective view illustrating access to the patient in the upper torso garment component.
Figure 7:
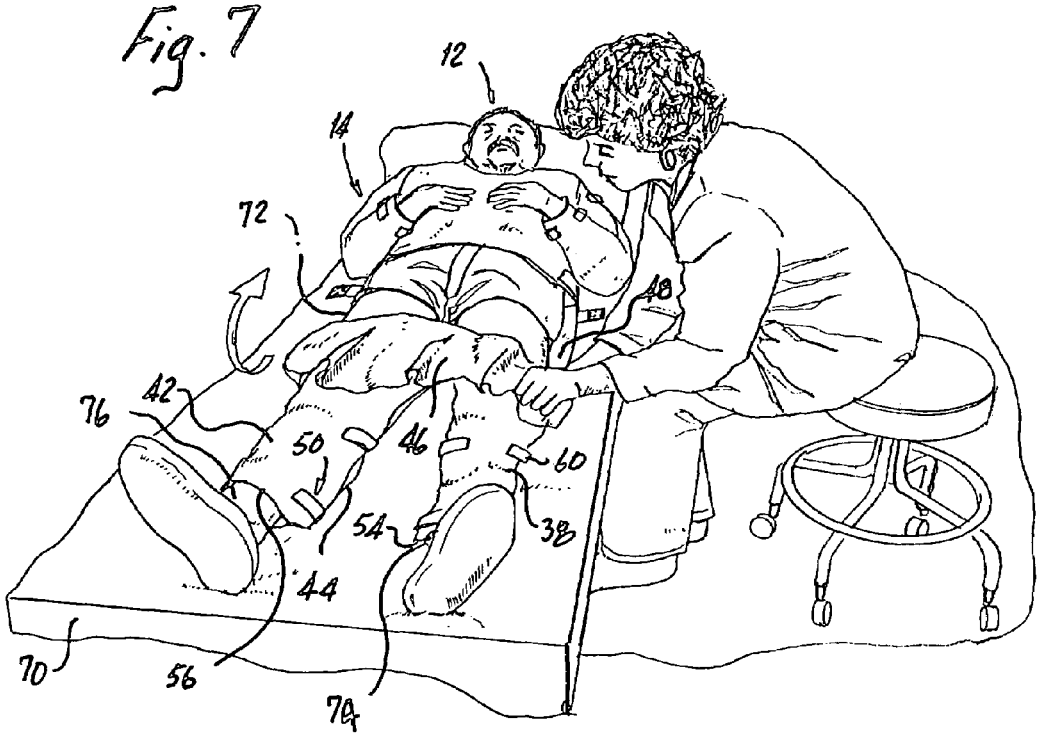
FIG. 7, similar to FIG. 5, illustrates the minimal assisted use of the garment component of FIG. 3, but of the within inventive method step as applied to the lower torso garment component.
Figure 8:
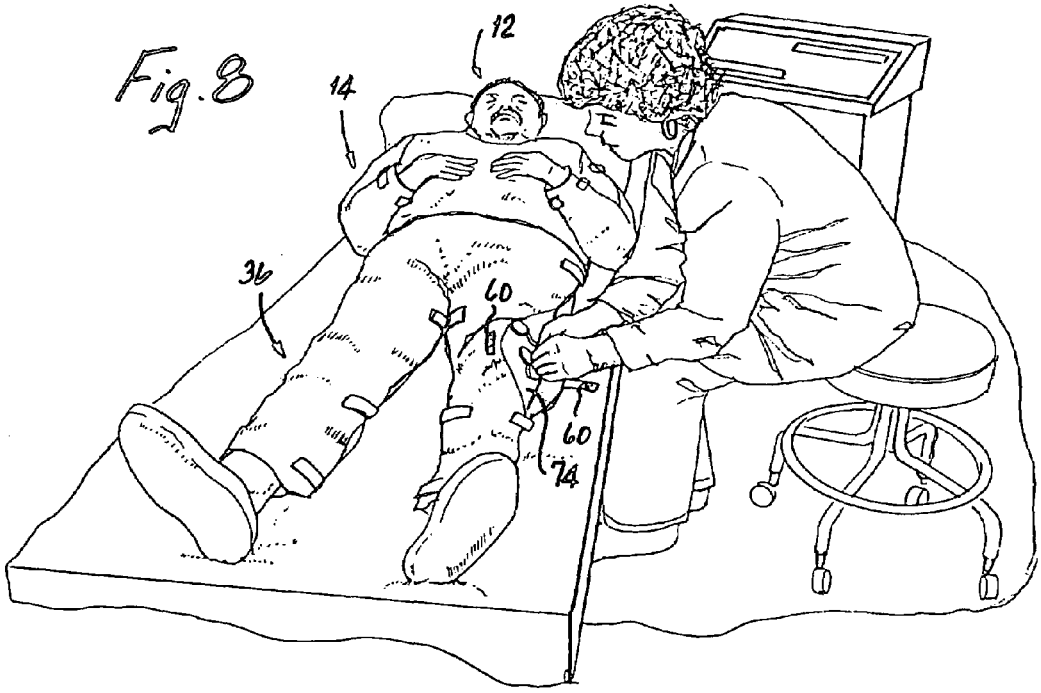
FIG. 8 is similar to FIG. 7, illustrating details of the method step of FIG. 7.

The unassisted dressing of the patient 10 using the die cut blanks 14 and 36 is best understood from FIGS. 5 and 7. The patient 10 places her/his head 62 through the neck opening 34 sized appropriately, and places in alignment the front and rear panels 24, 26 resulting from their condition of being depending from the shoulder coverings 28, 30, said alignment concomitantly facilitating the alignment of the strips 60 for temporarily completing the covering by the garment 10 about the patient's arms 64 and 66 and upper torso 68.

Next, the die cut blank 36 is placed flat on a surface, such as a bed 70, and the patient 10 positions her/his buttocks 72 on what is to be the buttocks covering 48 and projects her/his legs 74 and 76 through the leg dressing openings 54 and 56.

The patient 10 aligns the interconnected leg coverings 40, 42 and 42, 44 in superposed relation, a chore readily achieved because of their interconnection at attachment locations 50 and said alignment concomitantly aligns the strips 60 for temporarily completing the covering of the legs 74 and 76 and length portions of the stomach and buttocks coverings 46 and 48.

It is contemplated that the attachment of the strips 60 to each other to complete the covering of encircled anatomy of the patient 10 only be of a temporary nature as noted because a medical procedure may require access to the patient's arm 64, for example, for intravenous feeding, or to the patient's leg 74, for example, for examination, in which instance the needed access is readily provided by unattaching the appropriate strips 60.

While the patient garment and dress-up method of the within invention herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A method of dressing a hospital patient with a garment comprising the steps of:

providing a first panel of fabric construction material serving as an upper torso-covering having a flat shape and configuration, providing a front garment panel on said first panel, providing a rear garment panel on said first panel, providing shoulder-covering areas interconnecting said front and rear garment panels, bounding edges of a neck opening between said shoulder-covering areas, two extending left cooperating sleeve length portions from a shoulder-covering area in initial unconnected relation of said length portions, and two extending right cooperating sleeve length portions from a shoulder-covering area in initial unconnected relation of said length portions, providing a second panel of fabric construction material serving as a lower torso-covering having a flat shape and configuration, providing a proximal buttock-covering panel on said second panel, providing left and right leg-covering length portions on said second panel and extending in depending relation from said proximal buttock-covering panel to a distal stomach-covering panel, and in an intermediate medial location between said buttock and stomach-covering panels a pair of leg openings formed through said leg-covering length portion with edges bounding said leg openings, projecting said patient's head through said neck opening, closing said front and rear garment panels in enclosing relation about said patient, connecting confronting edges of said sleeve length portions together in a selectively detachable manner, projecting said patient's left and right ankles through said leg openings, closing said front and rear leg-covering length portions in enclosing relation about said patient, connecting confronting edges of said leg covering length portions together in a selectively detachable manner, and disconnecting said interconnected confronting edges of said upper and lower torso-covering garments in a selective manner, whereby said disconnected confronting edges bound access openings to said patient for medical procedures.

* * * * *